US005114504A

United States Patent [19]

AbuJudom, II et al.

[11] Patent Number: 5,114,504

[45] Date of Patent: May 19, 1992

[54] HIGH TRANSFORMATION TEMPERATURE SHAPE MEMORY ALLOY

[75] Inventors: David N. AbuJudom, II, Brookfield; Paul E. Thoma, Cedarburg; Ming-Yuan Kao, Fox Point; David R. Angst, West Allis, all of Wis.

[73] Assignee: Johnson Service Company, Milwaukee, Wis.

[21] Appl. No.: 609,377

[22] Filed: Nov. 5, 1990

[51] Int. Cl.[5] ..... C22C 14/00; C22C 19/00

[52] U.S. Cl. ..... 148/402; 420/451; 420/580

[58] Field of Search ..... 148/402; 420/580; 1/451

[56] References Cited

U.S. PATENT DOCUMENTS

| | | | |
|---|---|---|---|
| 3,174,851 | 3/1965 | Buehler | 75/170 |
| 3,660,082 | 5/1972 | Negishi et al. | 420/451 |
| 3,832,243 | 8/1974 | Donkersloot et al. | 148/32 |
| 4,019,899 | 4/1977 | Negishi et al. | 420/580 |
| 4,144,057 | 3/1979 | Melton et al. | 148/11.5 N |
| 4,304,613 | 12/1981 | Wang et al. | 148/11.5 F |
| 4,310,354 | 1/1982 | Fountain et al. | 75/211 |
| 4,337,090 | 6/1982 | Harrison | 148/402 |
| 4,412,872 | 11/1983 | Albrecht et al. | 148/402 |
| 4,505,767 | 3/1985 | Quin | 148/402 |
| 4,565,589 | 1/1986 | Harrison | 148/402 |
| 4,740,253 | 4/1988 | Simpson et al. | 148/402 |
| 4,759,906 | 7/1988 | Nenno et al. | 148/402 |
| 4,808,225 | 2/1989 | Donachie et al. | 75/246 |
| 4,865,663 | 9/1989 | Tuominen et al. | 148/402 |
| 4,874,577 | 10/1989 | Wakita et al. | 420/451 |
| 4,881,981 | 11/1989 | Thoma et al. | 148/402 |
| 4,894,100 | 1/1990 | Yamauchi et al. | 148/402 |
| 4,950,340 | 8/1990 | Wakita et al. | 148/402 |

FOREIGN PATENT DOCUMENTS

| | | | |
|---|---|---|---|
| 2037353 | 2/1987 | Japan | 148/402 |

OTHER PUBLICATIONS

Lindquist, "Structure and Transformation Behavior of Martensitic Ti-(Ni,Pd) and Ti-(Ni,Pt) Alloys", Thesis, University of Illinois, 1978.

Wu, "Interstitial Ordering and Martensitic Transformation of Titanium-Nickel-Gold Alloys", U. of Illinois, 1986.

Calculation of Influence of Alloying on the Characteristics of the Martensitic Transformation in Ti-Ni, Chernov, 1982.

Martensitic Transformation in Alloyed Nickel-Titanium, 1986 "Metalphysics" vol. 8, N.2, p. 38.

*Primary Examiner*—Upendra Roy

*Attorney, Agent, or Firm*—Foley & Lardner

[57] ABSTRACT

A high temperature titanium-based shaped memory alloy contains from at least 0.1 at. % hafnium. Articles formed from the disclosed alloy have high transformation temperatures. The alloy of the invention can be successfully hot and cold worked to make articles such as springs and wires.

11 Claims, 4 Drawing Sheets

HIGH TRANSFORMATION TEMPERATURE SHAPE MEMORY ALLOY

TECHNICAL FIELD

This invention relates to shape memory alloys (SMA), more particularly, to nickel-titanium based shape memory alloys.

BACKGROUND OF THE INVENTION

An article made of an alloy having a shape memory can be deformed at a low temperature from its original configuration. Upon application of heat, the article reverts back to its original configuration. Thus, the article "remembers" its original shape.

For example, in nickel-titanium alloys possessing shape memory characteristics, the alloy undergoes a reversible transformation from an austenitic state to a martensitic state with a change in temperature. This transformation is often referred to as a thermal elastic martensitic transformation. The reversible transformation of the Ni-Ti alloy between the austenite to the martensite phases occurs over two different temperature ranges which are characteristic of the specific alloy. As the alloy cools, it reaches a temperature ($M_s$) at which the martensite phase starts to form and finishes the transformation at a still lower temperature ($M_f$). Upon reheating, it reaches a temperature ($A_s$) at which austenite begins to reform and then a temperature ($A_f$) at which the change back to austenite is complete. In the martensitic state, the alloy can be easily deformed. When sufficient heat is applied to the deformed alloy, it reverts back to the austenitic state, and returns to its original configuration.

Titanium and nickel-titanium base alloys capable of possessing shape memory are widely known. See, for example, Buehler U.S. Pat. No. 3,174,851 issued Mar. 23, 1965, and Donkersloot et al., U.S. Pat. No. 3,832,243, issued Aug. 27, 1974. Commercially viable alloys based on nickel and titanium having shape memory properties have been demonstrated to be useful in a wide variety of applications in mechanical devices.

Albrecht, et al., U.S. Pat. No. 4,412,872 issued Nov. 1, 1983 indicates that memory alloys based on Ni-Ti possess an $M_S$ temperature which cannot, for theoretical reasons, exceed 80° C., and in practical cases usually does not exceed 50° C. Conventional nickel-titanium alloys are therefore unsuitable for use in high temperature applications such as heating, ventilating and air conditioning applications, which require $M_s$ temperatures exceeding about 80° C. (176° F.).

Nickel-titanium base alloys have been modified to obtain different properties. For example, it is known that higher transitions can be obtained by substituting gold, platinum, and/or palladium for nickel. See, Lindquist, "*Structure and Transformation Behavior of Martensitic Ti-(Ni,Pd) and Ti-(Ni,Pt) Alloys*", Thesis, University of Illinois, 1978 and Wu, *Interstitial Ordering and Martensitic Transformation of Titanium-Nickel-Gold Alloys,* University of Illinois at Urbana-Champaign, 1986. Additions of these elements, however, make the ternary alloys quite expensive. Tuominen et al., U.S. Pat. No. 4,865,663 issued Sep. 12, 1989, discloses high temperature shape memory alloys containing nickel, titanium, palladium and boron. Nenno, et al., U.S. Pat. No. 4,759,906 issued Jul. 26, 1988 discloses a high temperature shape memory alloy comprising 40–60 atomic % Ti, 0.001–18 atomic % Cr, and the balance being Pd.

Donkersloot et al. U.S. Pat. No. 3,832,243, issued Aug. 27, 1974, describes a variety of Ni-Ti shape memory alloys, including $Ni_5Ti_4Zr$.

Various other additions to the conventional nickel-titanium alloy are known. For example, iron, copper, niobium and vanadium have each been suggested additives for various reasons. See, Harrison, U.S. Pat. No. 4,565,589 issued Jan. 21, 1986 which discloses a low $M_S$ alloy having from 36–44.75 atomic % nickel, from 44.5–50 atomic % titanium and the remainder copper; Harrison, U.S. Pat. No. 4,337,090 issued Jun. 29, 1982; and Quin, U.S. Pat. No. 4,505,767 issued Mar. 19, 1985. Melton, et al., U.S. Pat. No. 4,144,057 discloses a shape memory alloy consisting essentially of a mixture of 23–55 wt. % nickel, from 40–46.5 wt. % titanium and 0.5–30 wt. % copper, with the balance being from 0.1 to 5 wt. % of aluminum, zirconium, cobalt, chromium and iron.

Two Russian articles discuss the effect of various elements on the conventional nickel-titanium base alloy. "Calculation of Influence of Alloying on the Characteristics of the Martensitic Transformation in Ti-Ni", (D.B. Chernov, 1982) discloses the results of studies wherein the interaction of some 32 elements with nickel and titanium were calculated using experimental phase diagrams and on the basis of empirical methods. These calculations were then compared with known experimental data for ternary alloys of Ni-Ti and Nb, Cr, Fe, Co, Pd, Cu, Al, Si and Ge. The author concluded that one may expect that the martensitic peak temperature ($M_p$), per one atomic % of the alloying component, may be raised or lowered by the addition of Cr, Ag, Au, Hf and Sc.

Another Russian article entitled "Martensitic Transformation in Alloyed Nickel-Titanium" (1986) identifies the results of x-ray diffraction studies of structural transformations in nickel-titanium alloys alloyed with transition elements. The article discloses that when titanium is replaced by zirconium and hafnium, the martensitic transformation in Ni-Ti is conserved, but with significant lowering of the $M_S$ temperature. The composition of the disclosed alloy is $Ni_{50.5}Ti_{46}Hf_{3.5}$.

Many methods of forming shape memory alloys are known. For example, Thoma, et al., U.S. Pat. No. 4,881,981 issued Nov. 21, 1989, relates to a method of producing shape memory alloys. The method includes the steps of increasing the internal stress level, forming the member to a desired configuration, and heat treating the member at a selected memory imparting temperature. Other processing methods are taught by Wang, et al., U.S. Pat. No. 4,304,613 issued Dec. 8, 1981, and Fountain, et al., U.S. Pat. No. 4,310,354 issued Jan. 12, 1982.

Donachie, et al., U.S. Pat. No. 4,808,225 issued Feb. 28, 1989, discloses a process similar to that of Fountain, et al., but which comprises the steps of providing metal powder having at least 5 wt. % of one or more reactive elements such as titanium, aluminum, hafnium, niobium, tantalum, vanadium and zirconium. The powder is consolidated to an essentially fully dense shape, and then, localized areas of the consolidated shape are progressively melted and solidified to produce a product of improved ductility. Nickel-titanium alloys containing at least 45 wt. % nickel and at least 30 wt. % titanium are preferred. None of these known processing methods provide Ni-Ti alloys usable in high temperature applications.

The present invention addresses the problems and disadvantages of the prior art and provides a high transformation temperature shape memory alloy which has good strength characteristics and is more economical to use than the commercially available high temperature SMA.

SUMMARY OF THE INVENTION

In a high temperature shape memory titanium based alloy according to the invention, hafnium or hafnium and zirconium are substituted for titanium. A nickel-rich alloy of the invention preferably contains hafnium or hafnium and zirconium in an amount of at least 4 at. %, provided that the amount of hafnium is at least 1 at. % of the alloy. In alloys of the invention where the amount of nickel is less than 50 at. %, particularly less than 49.9 at. %, hafnium or hafnium and zirconium are substituted for titanium in an amount of at least 0.1 at. %, preferably at least 0.5 at. %. Contrary to the teachings of the prior art, it has been found that the addition of hafnium to a nickel-titanium base alloy increases the transformation temperatures and strength, while maintaining reasonable formability characteristics of the alloy, allowing the fabrication of useful articles. $A_f$ of such an alloy is at least about 110° C., preferably 160° C., and particularly 110°-500° C.; the corresponding $M_s$ is at least 80° C. and particularly 80°-400° C. Articles formed from the alloy according to the invention useful in high temperature applications are also provided, together with a method for forming the alloy of the invention.

DETAILED DESCRIPTION OF THE PREFERRED EXEMPLARY EMBODIMENTS

Figure 1:
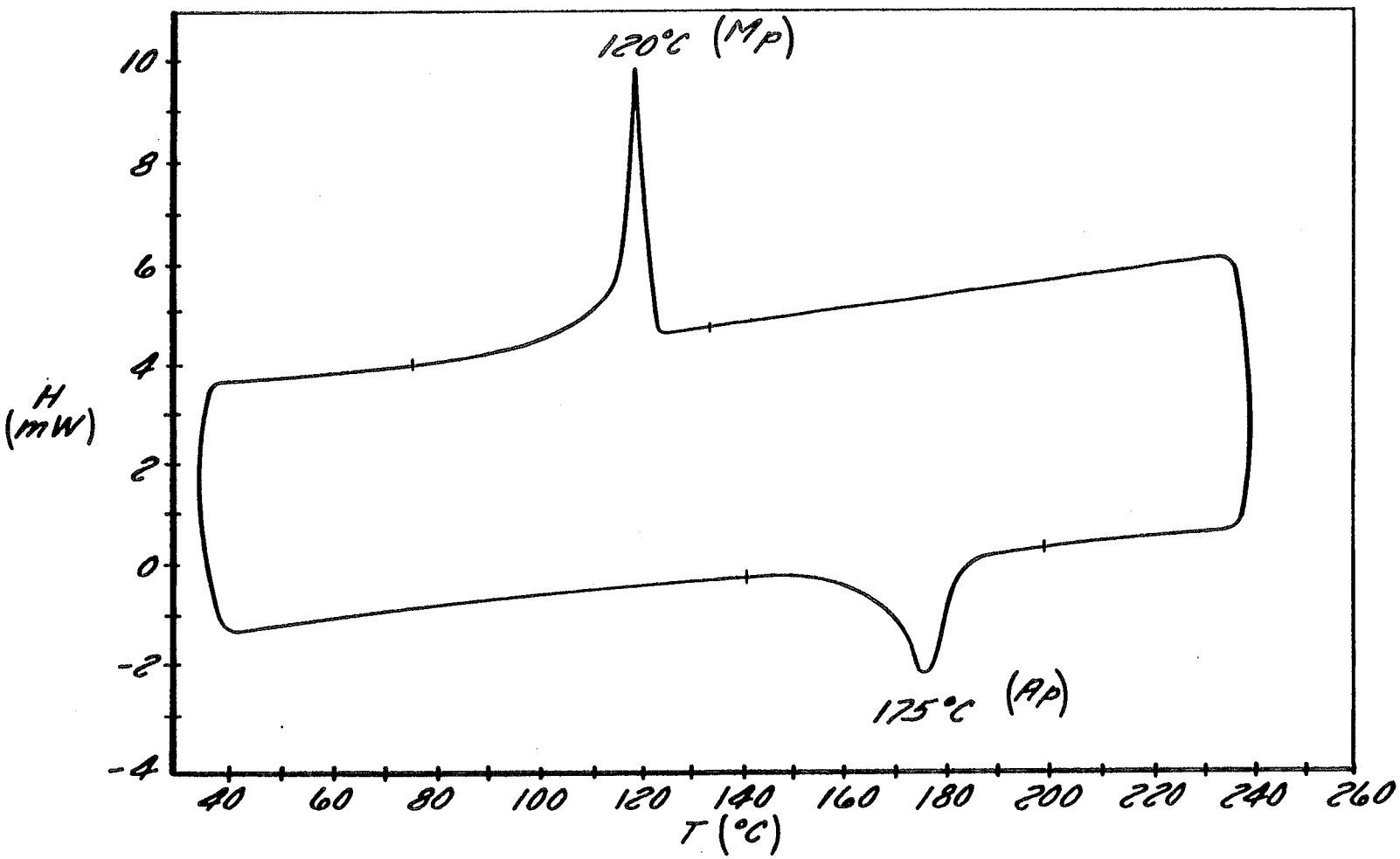
FIG. 1 is a differential scanning calorimetry (DSC) plot of heat in mW versus temperature for $Ni_{49}Ti_{41}Hf_{10}$ an alloy of the invention.

Alloys of the invention can be represented by the general formula:

$$M_ATi_{(100-A-B)}X_B$$

wherein M is a metal other than zirconium and hafnium, particularly one or more elements selected from elements such as nickel, copper, gold, platinum, iron, manganese, vanadium, aluminum, palladium, tin and cobalt. A is 30 to 51 at. %, B is 0.1 to 50 at. %, and X is Hf or a combination of Hf and Zr, provided that the amount of Zr does not exceed 25 at. % in the alloy, the amount of Hf is at least 0.1 at. %, and the sum of A+B is 80 or less. For optimum performance in alloys where A is greater than 50 up to 51, B is preferably at least 4, preferably 4 to 49 at. %, and the alloy contains at least 1 at. % Hf.

Ni-Ti is the most widely used titanium-based binary, but other metals can be used in place of nickel in titanium-based alloys according to the invention, such as those described above. Accordingly, a high temperature titanium-based shape memory alloy of the invention may consist essentially of about 30 to 51 at. % of one or more metals, preferably one or more elements selected from the group consisting of nickel, copper, gold, platinum, iron, manganese, vanadium, aluminum, palladium, tin and cobalt, about 0.1 to 50 at. % of a second element selected from hafnium or a combination of hafnium and zirconium, provided that the amount of zirconium does not exceed about 25 at. %, preferably 10 at. % of said alloy, and the balance is titanium, provided further that the amount of titanium is at least about 20 at. % of the alloy. Narrower subranges of 42-50 at. % or even 48-50 at. % for Ni, alone or in combination with one or more the other recited elements, are preferred for forming certain types of SME articles, such as high temperature springs, wires, and actuators. Comparable subranges for Hf or Hf-Zr are 0.1 to 40 at. %, 0.1 to 25 at. %, 0.5 to 25 at. %, or even 5 to 25 at. %. A low range of 0.5 to 8 at. % Hf or Hf-Zr, for example, can provide sufficient shape memory effects for some applications, without limiting ductility.

The amount of hafnium contained in Ni-Ti alloys of the invention is preferably from about 3.5 to 50 at. %, with subranges of 3.5 to 40 at. %, 8 to 25 at. %, and 4 to 20 at. %. It has been found that 1 at. % Hf actually lowers the transformation temperature range of the resulting Ni-Ti-Hf alloy to less than that of the Ni-Ti base alloy. On the other hand, amounts of about 20 to 50 at. % Hf tend to embrittle the alloy.

In general, preferred alloys of the invention are formed by substituting hafnium (Hf) for titanium (Ti) in Ti-Ni binary alloys wherein Ni is depleted to less than 50 at. %. A preferred base binary alloy is $Ni_{49}Ti_{51}$, the binary having the highest known transformation temperature. The amount of titanium contained in these alloys of the invention varies depending on the amount of hafnium used. The amount of hafnium in these alloys is preferably from about 0.1 to 49 at. %, more preferably about 0.1 to 25 at. %, and especially about 0.1 to 20 at. %.

The alloy compositions of the invention are preferably formed using substantially (99.7%) pure hafnium as a starting material. However, zirconium and hafnium occur together in nature and are two of the most difficult elements to separate. Even purified hafnium may contain up to 5 weight percent zirconium (Zr), and generally contains about 2 to 3 weight percent zirconium.

Figure 7:
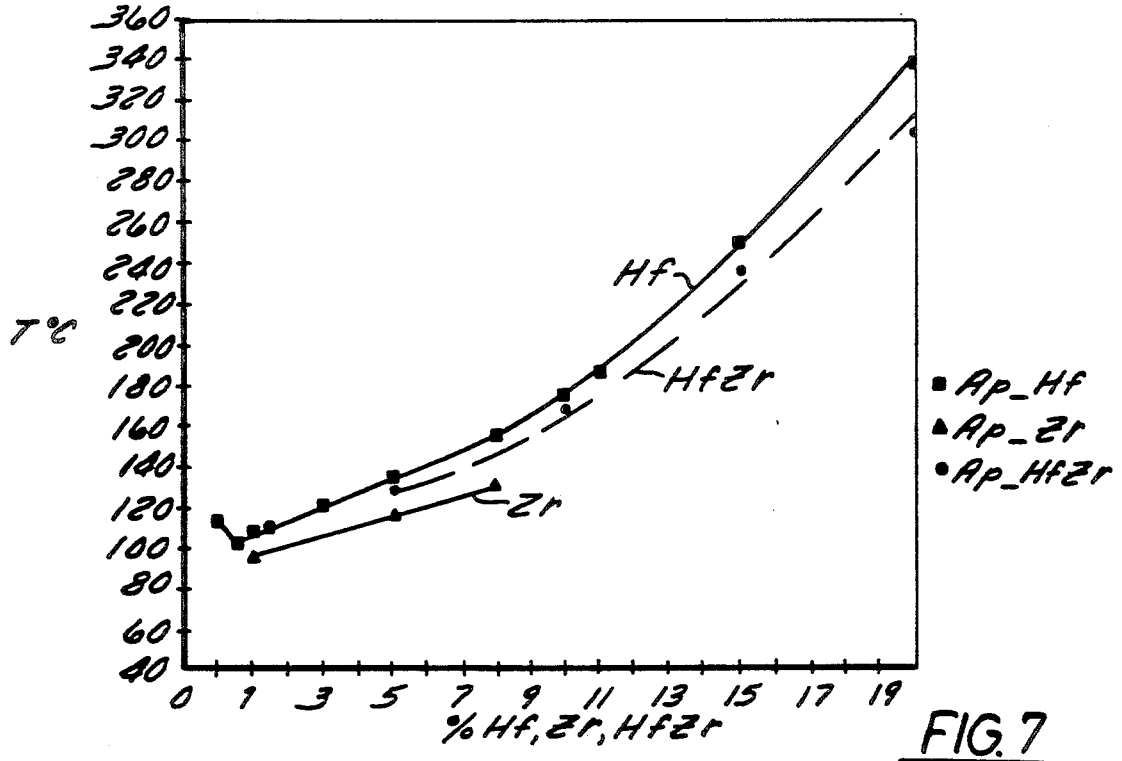
FIG. 7 is similar to FIG. 2, showing additional alloys containing zirconium.

Hafnium may also be purposely added to an Ni-Ti-Zr alloy to obtain the advantages of the present invention. However, if the Zr content is too high, the total amount of Hf and Zr which is added to the Ni-Ti binary base alloy to obtain the desired high transformation temperature range tends to reduce the ductility of the alloy. Substituting Zr alone yields alloys having considerably lower transformation temperatures than with those with essentially pure Hf substitutions, as illustrated in FIG. 7. The amount of Zr needed to obtain a comparable transformation temperature tends to highly embrittle the alloy, whereas the smaller amount of Hf needed to obtain the same temperature tends not to produce such an undesirable effect. For example, referring to FIG. 7, to obtain a transformation temperature of 140° C., about 8 atomic percent Zr is needed which tends to embrittle the alloy. On the other hand, about 5 atomic percent Hf yields the same 140° C. transformation temperature, and the alloy is more workable and easier to process into articles.

The alloys of the invention are prepared according to conventional procedures, such as vacuum arc melting, vacuum induction melting, plasma melting, electron beam melting or the like. The as-cast end product is then subjected to various hot and/or cold working, annealing, and heat treatment to impart shape memory effect (SME) to the alloy. Exemplary of some of these procedures is the method for producing a shape memory alloy member disclosed in U.S. Pat. No. 4,881,981, issued Nov. 21, 1989.

The specific treatment procedure used depends upon the particular element characteristics desired. Such elements may take the form of wires, flat springs, coil springs, and other useful engineering configurations, such as damper valve actuators. Keeping in mind that the relative amount of cold working depends highly on the composition of the alloy, articles such as leaf springs or the like can be formed by cold working the alloy to a reduction in area of between about 5 and 30%, followed by heat treatment to impart memory to the desired shape. Articles according to the invention preferably have as-cast, fully-annealed transition temperatures wherein $A_f$ is at least about 110° C., and $M_s$ is at least about 80° C.

A preferred process for forming shape memory effect wire according to the invention is as follows. An Ni-Ti-Hf ingot, wherein Hf contains up to 5 wt. % Zr as an unavoidable impurity, is first formed. The ingot is hot worked at a temperature typically at least 800° C. for a number (e.g., 5 or more) of passes each at a small area reduction, e.g., 5–15%. The surface of the alloy is then cleaned, and a short annealing step is then carried out, for example, at a temperature of at least 800° C. for at least 10 minutes. A series of cold working reduction steps then follows, with a stress-relieving annealing step after one or more of the cold working steps. Each cold working step effects a further area reduction ranging from about 3–30%. The last cold working step is followed by a longer, inter-annealing step, for example, at a temperature of at least 600° C. for one hour. A succession of cold working steps then follows, preferably at successively increasing reductions ranging again from 3–30%. After the desired cold working is complete, the alloy is formed into the desired shape, e.g., held by a fixture, and heated to a temperature sufficient to obtain a permanent, reversible shape memory effect whenever the part is reheated above the $A_f$ temperature.

The general nature of the invention having been set forth above, the following examples are presented as illustrations thereof. It will be understood that the invention is not limited to these specific examples, but is susceptible to various modifications that will be recognized to those of ordinary skill in the art.

EXAMPLE 1

Ternary alloys with varying compositions of nickel (Ni), titanium (Ti) and hafnium (Hf) were prepared using high purity Ni and Ti rods, and substantially pure Hf rod or wire (99.7&, 3.1 wt. % of which is zirconium). The various compositions of the alloys prepared are provided in Table I, along with their as-cast transformation temperatures.

TABLE I

| at. % Hf | at. % Ti | at. % Ni | $M_p$ (°C.) | $A_p$ (°C.) |
|---|---|---|---|---|
| 0.0 | 51.0 | 49.0 | 69 | 114 |
| 0.5 | 50.5 | 49.0 | 62 | 104 |
| 1.0 | 50.0 | 49.0 | 69 | 109 |
| 1.5 | 49.5 | 49.0 | 60 | 105 |
| 3.0 | 48.0 | 49.0 | 76 | 122 |
| 5.0 | 46.0 | 49.0 | 80 | 134 |
| 8.0 | 43.0 | 49.0 | 86 | 156 |
| 10.0 | 41.0 | 49.0 | 120 | 175 |
| 11.0 | 40.0 | 49.0 | 129 | 186 |
| 15.0 | 36.0 | 49.0 | 203 | 250 |
| 20.0 | 31.0 | 49.0 | 307 | 359 |
| 25.0 | 26.0 | 49.0 | 395 | 455 |
| 30.0 | 21.0 | 49.0 | 525 | 622 |

The weight of each element for each of the above alloys was first calculated from the alloy formula, and then the raw materials were weighed. The raw materials were then placed in a furnace equipped with a mechanical vacuum pump and a power supply. The alloys were prepared using an arc melting process. The sample was then melted and flipped for a total of six times to assure a homogeneous button-shaped alloy.

It should be appreciated that the atomic percentages provided in Table I are the initial compositions and not the compositions of the as-cast, analyzed alloy buttons. It is suspected that arc melting volatilizes one or more of the alloy components, most likely the effect being most pronounced on Ti. Alloy compositions of the as-cast alloy buttons may therefore be different than those listed in Table I.

Samples of the as-cast alloy buttons were analyzed for transformation temperatures using Differential Scanning Calorimetry (DSC) in a DuPont 990 DSC cell with either a model 1090 or 2100 DuPont controller. Ten milligram (±1.0 mg.) samples were run at a constant scanning rate of 10° C./min.

The DSC plot for one of the alloys of the invention, $Ni_{49}Ti_{41}Hf_{10}$, is shown in FIG. 1. A martensite peak ($M_P$) temperature of 120° C. and an austenite peak ($A_P$) temperature of 175° C. were obtained for this alloy composition. DSC plots similar to that shown in FIG. 1 were obtained for each of the alloy compositions listed in Table I. For the illustrated alloy, a fully annealed state is reached at about 900°–950° C.

Figure 2:
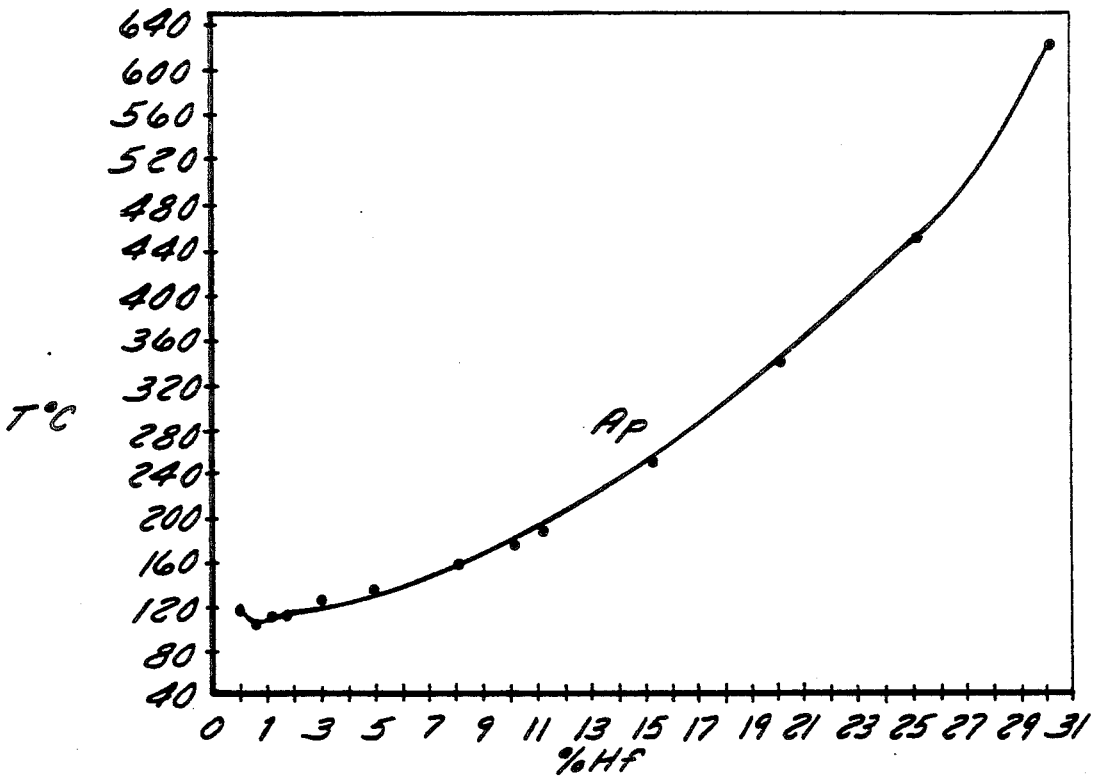
FIG. 2 is a graph of temperature versus atomic percent Hf showing the effect of hafnium content on the austenite transformation peak temperatures $A_p$ of alloys of the invention having a fixed nickel content of formula $Ni_{49}T_{51-B}Hf_B$, where B is at. % Hf as plotted.

FIG. 2 shows the effect of hafnium content on the Ni-Ti-Hf alloys of the invention having 49 atomic percent Ni. The transformation temperatures of the alloys of the invention having Hf contents greater than about 1.5 at. % were found to substantially increase with increasing hafnium content. At about 10–11 at. % Hf, there is a drastic rise in transformation temperatures.

Figure 3:
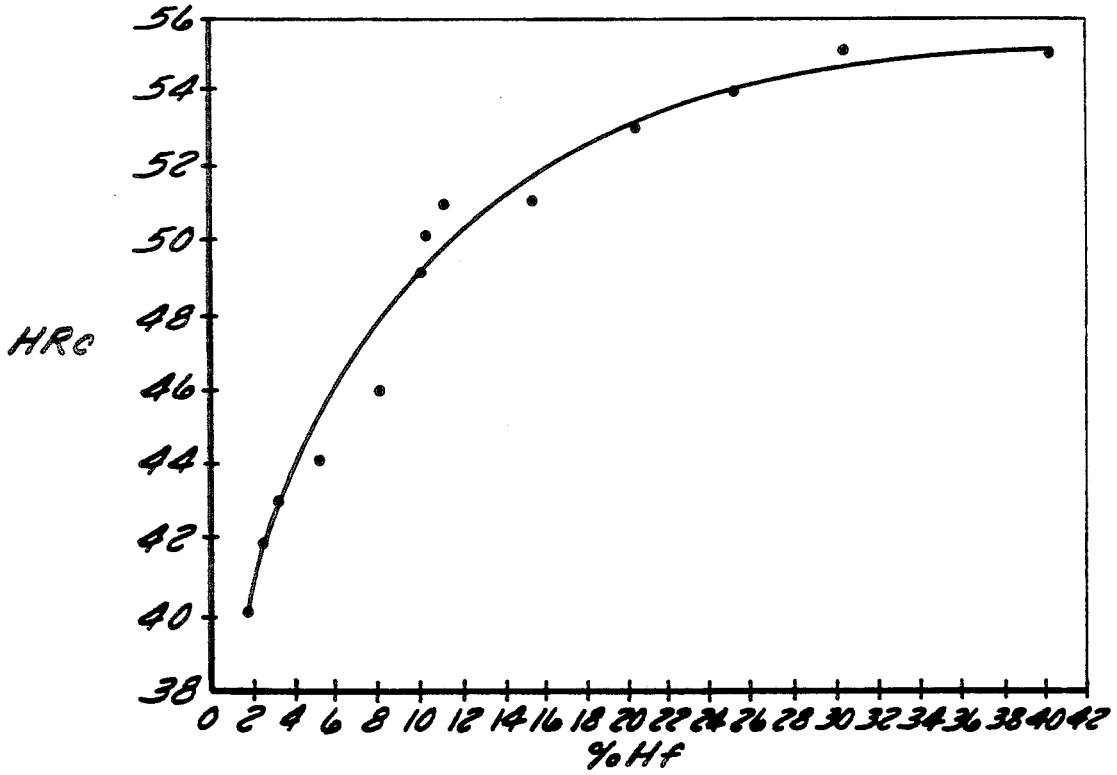
FIG. 3 is a graph of Rockwell hardness versus atomic percent Hf for the alloys described in FIG. 2.

Hardness tests were performed on a sample of each of the alloys listed in Table I using a standard Rockwell indentor according to conventional methods. As shown in FIG. 3, the Rockwell Hardness ($HR_C$) of these alloys ranges from about 40 to about 55, indicating that the alloys of the invention are resistant to surface indentations and that such resistance increases with increasing hafnium content.

EXAMPLE 2

Figure 4:
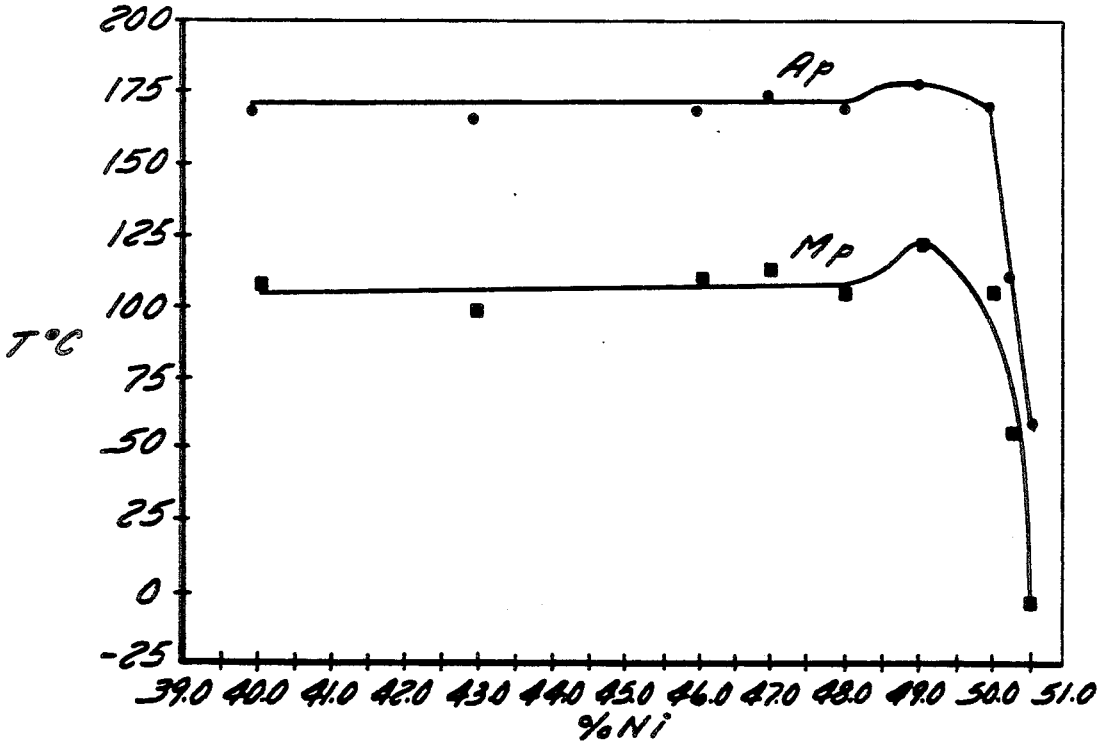
FIG. 4 is a graph of temperature versus atomic percent Ni showing the effect of nickel content on the transformation peak temperatures of alloys of the invention having the formula $Ni_ATi_{90-A}Hf_{10}$, where A is at. % Ni as plotted.

Ternary Ni-Ti-Hf alloys having 10 atomic percent Hf with varying contents of nickel and titanium were prepared in the same manner as the alloy compositions of Example 1. The compositions and as-cast transformation temperatures of these alloys are shown in Table II and plotted in FIG. 4.

TABLE II

| at. % Hf | at. % Ti | at. % Ni | $M_p$ (°C.) | $A_p$ (°C.) |
|---|---|---|---|---|
| 10.00 | 50.00 | 40.0 | 108 | 168 |
| 10.00 | 44.00 | 46.0 | 108 | 168 |
| 10.00 | 43.00 | 47.0 | 111 | 172 |
| 10.00 | 42.00 | 48.0 | 103 | 167 |
| 10.0 | 41.0 | 49.0 | 120 | 175 |
| 10.00 | 40.00 | 50.0 | 104 | 168 |
| 10.00 | 39.75 | 50.25 | 53 | 107 |
| 10.00 | 39.50 | 50.5 | −6 | 57 |
| 10.00 | 39.00 | 51.0 | <−20 | 35 |

It can be seen that the nickel content has little effect on the transformation temperatures of the alloys of the invention in the range of about 40 to about 50 at. %. Transformation temperatures begin to drop rapidly above 50 at. % Ni.

EXAMPLE 3

Other nickel-rich ternary alloy compositions having the compositions listed in Table III were prepared in the same manner as in the previous examples. The peak transformation temperatures obtained from thermal analysis conducted according to the procedure described in Example 1 are also provided.

TABLE III

| at. % Hf | at. % Ti | at. % Ni | $M_p$ (°C.) | $A_p$ (°C.) |
|---|---|---|---|---|
| 25.0 | 25.0 | 50.0 | 405 | 430 |
| 25.0 | 24.5 | 50.5 | 308 | 477 |
| 15.0 | 34.75 | 50.25 | 184 | 234 |
| 12.5 | 37.25 | 50.25 | 124 | 174 |

The foregoing results show that addition of Hf also increases the transformation temperatures of binary alloys containing 50 at. % or more Ni.

The foregoing results show that addition of Hf also increases the transformation temperatures of binary alloys containing 50 at. % or more Ni.

EXAMPLE 4

Figure 5:
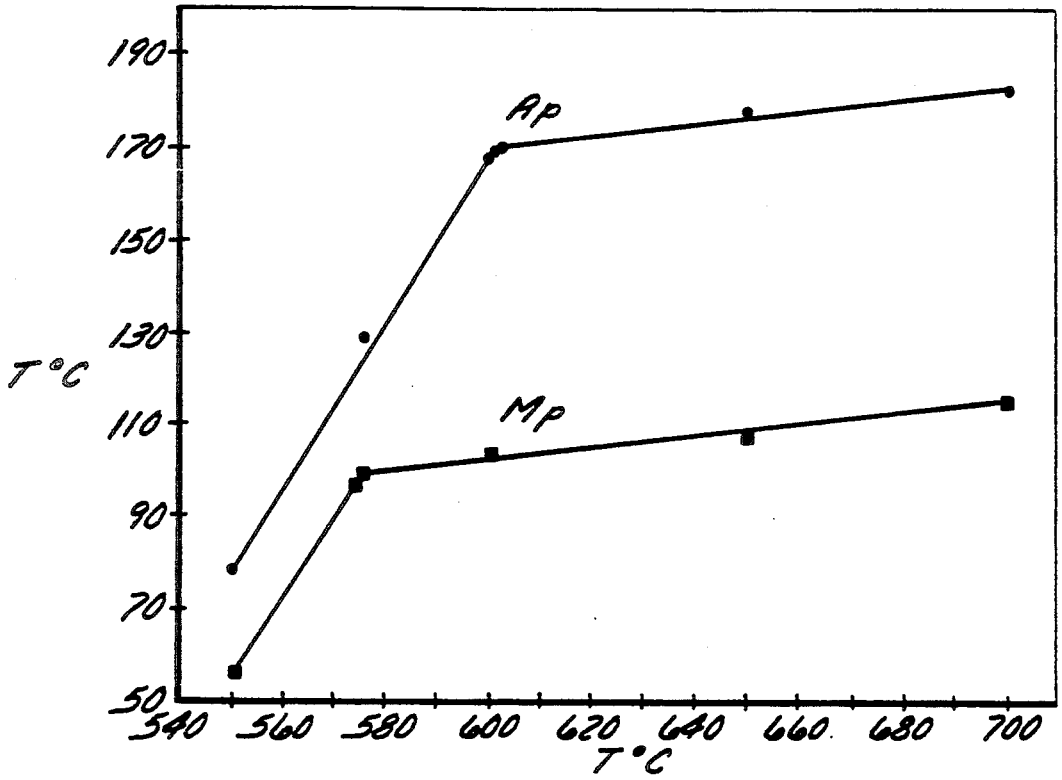
FIG. 5 is a graph of the austenite and martensite transformation peak temperatures $A_p$ and $M_p$ versus heat treating temperature obtained for about 30% cold worked wire formed from the $Ni_{49}Ti_{41}Hf_{10}$ alloy of the invention heat treated at memory imparting temperatures of 550° C., 575° C., 600° C., 650° C. and 700° C. for one hour.

A 20 gram ingot of $Ni_{49}Ti_{41}Hf_{10}$ alloy was prepared according to the procedure of Example 1. This ingot was about 31 mm long, 8 mm wide and 7 mm high. A portion of the ingot having a 3mm×3mm cross-section was hot worked above the recrystallization temperature at about 900° C. for six passes with approximately a 10% reduction in area per pass using a two-high rolling mill with round-corner-square grooves. The sample was fully reheated between each reduction. The sample was then cold worked a number of times, to approximately 15% reduction in area, with inter-anneals at a temperature of 700° C. for approximately 5 minutes. Thereafter the alloy was cold worked, first to approximately 13% reduction in area, and then to approximately a 25% reduction in area. Inter-annealing of the alloy then was carried out by heating it to 650° C. for approximately one hour. The alloy was then cold worked to a 15% area reduction, then a second time to a 23% area reduction. The resulting cold worked samples were then placed into fixtures and individually subjected to memory imparting heat treatments at temperatures between about 550° and 700° C. for 1 hour. The DSC plots are shown in FIG. 5. As can be seen, the transformation temperatures begin to level out at memory imparting heat treatment temperatures above 600° C.

EXAMPLE 5

Figure 6:
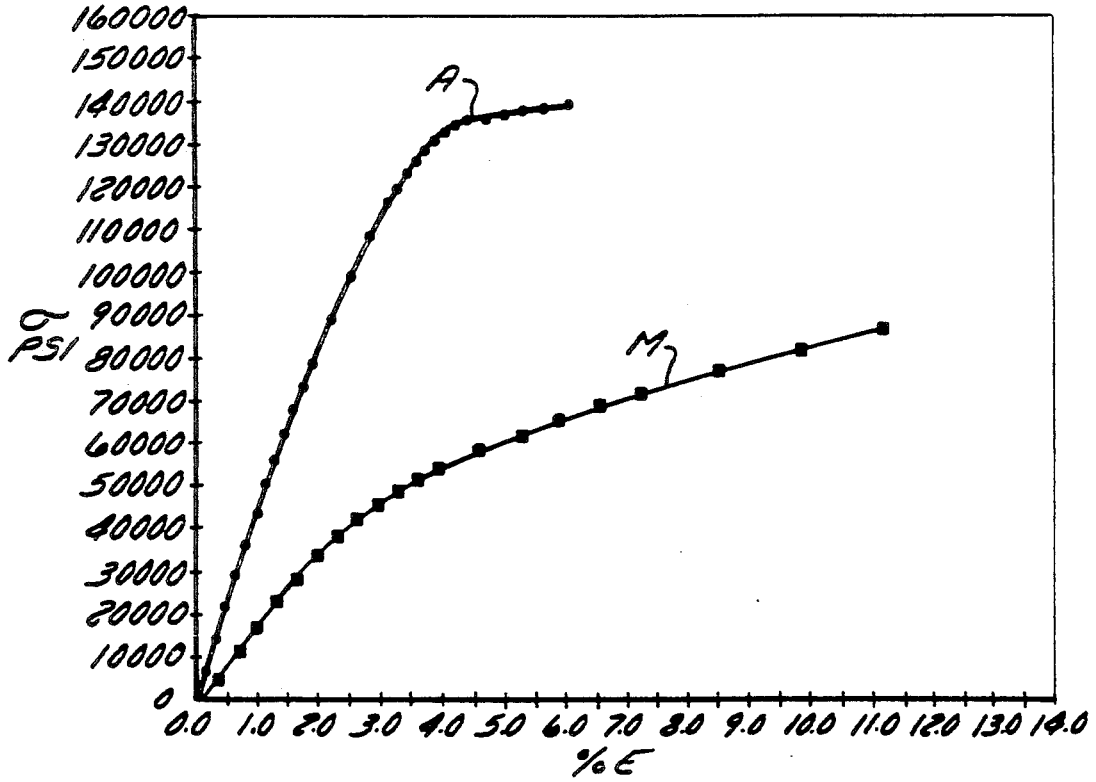
FIG. 6 is a graph plotting stress $\sigma$ in psi versus strain $\epsilon$ in % elongation for an article of the invention having the formula $Ni_{49}Ti_{41}Hf_{10}$.

Two sections of wire prepared as in Example 4 were heat treated at 575° C. These sections were then tension tested in the martensitic phase and above the austenitic finish temperature. The stress-strain results of these tests are shown in FIG. 6 for austenite (A) and martensite (M) phases at 208° C. and 75° C., respectively.

EXAMPLE 6

Samples containing both zirconium and hafnium were formed and analyzed according to the procedure of Example 1. The results are given in FIG. 7. Hf and Zr are used in equal at. % amounts. It can be seen that substituting Hf even in Ni-Ti-Zr ternaries results in increased transformation temperatures over those of Ni-Ti-Zr ternaries. Surprisingly, the transformation temperatures of the Ni-Ti-Hf-Zr quaternaries are close to those of the corresponding Ni-Ti-Hf ternaries.

It will be understood that the above description is of preferred exemplary embodiments of the invention, and that the invention is not limited to the specific forms shown. Modifications may be made in the specific illustrations described herein without departing from the scope of the present invention as expressed in the appended claims. For example, while the articles made from the alloys of the invention have been described as being formed by specific processing sequences, it should be appreciated that the alloys of the invention can be processed using other methods and can be used to form other functional elements.

We claim:

1. An article made of a shape memory titanium-based alloy, wherein said alloy has been subjected to a memory-imparting heat treatment, and the alloy consists essentially of a composition of the general formula:

$$M_A Ti_{(100-A-B)} X_B$$

wherein M consists essentially of nickel, A is from about 30 to 51 at. %, B is from about 3.5 to 40 at. %, and X is a combination of Hf and Zr, provided that:

(a) the amount of Zr does not exceed about 25 at. % in the alloy;

(b) the amount of Hf is at least 0.1 at. %; and (c) the sum of A+B is 80 at. % or less.

2. The article of claim 1, wherein A is from about 42 to 50.5 at. %.

3. The article of claim 1, wherein A is from about 48 to 50 at. %.

4. The article of claim 1, wherein B is from about 5 to 25 at. %.

5. The article of claim 1, wherein X comprises about 5 at. % or less, relative to hafnium, of zirconium as an impurity.

6. The article of claim 1, wherein M consists of nickel.

7. The article of claim 1, wherein said article has as-cast, fully-annealed transition temperatures wherein $A_f$ is at least about 110° C., and $M_s$ is at least about 80° C.

8. The article of claim 1, wherein said alloy has been cold worked and subsequently heat treated to impart memory of a predetermined shape.

9. The article of claim 1, wherein the as-cast $A_f$ is in the range of 110°–500° C. and the as-cast $M_s$ is in the range of 80°–400° C.

10. An article made of a titanium-hafnium based alloy having shape memory characteristics, made by the process comprising the steps of:

making a titanium-based shape memory alloy consisting essentially of a composition of the general formula:

$$M_A Ti_{(100-A-B)} X_B$$

wherein M consists essentially of nickel, A is from about 30 to 51 at. %, B is from about 3.5 to 40 at. %, and X is Hf or a combination of Hf and Zr, provided that (a) the amount of Zr does not exceed about 25 at. % in the alloy, (b) the amount of Hf is at least 0.1 at. %, and (c) the sum of A+B is 80 at % or less;

hot working the alloy above its recrystallization temperature;

cold working the alloy;

forming the alloy into a desired shape; and imparting a shape memory of the desired shape to said alloy to form said article.

11. The article of claim 10, wherein said shape memory is imparted so that said article has an as-cast transition temperature range wherein $A_f$ is at least about 110° C. and $M_s$ is at least about 80° C.

* * * * *